US012326281B1

(12) United States Patent
Brooks

(10) Patent No.: US 12,326,281 B1
(45) Date of Patent: Jun. 10, 2025

(54) ADD-ON APPARATUS FOR CONVERTING A CONVENTIONAL AIR-SOURCE REFRIGERATION CYCLE FOR MULTIPLE HEAT TRANSFER OPTIONS

(71) Applicant: Barry Brooks, Pilot Hill, CA (US)

(72) Inventor: Barry Richard Brooks, Pilot Hill, CA (US)

( * ) Notice: Subject to any disclaimer, the term of this patent is extended or adjusted under 35 U.S.C. 154(b) by 0 days.

(21) Appl. No.: 18/218,044

(22) Filed: Jul. 4, 2023

Related U.S. Application Data

(60) Provisional application No. 63/389,537, filed on Jul. 15, 2022.

(51) Int. Cl.
*F25B 41/20* (2021.01)
*F25B 27/00* (2006.01)

(52) U.S. Cl.
CPC ..... *F25B 41/20* (2021.01); *F25B 27/00* (2013.01); *F25B 27/005* (2013.01)

(58) Field of Classification Search
CPC ..... F25B 41/20; F25B 27/00; F25B 27/005; F25B 41/22; F25B 41/24; F25B 41/26
See application file for complete search history.

(56) References Cited

U.S. PATENT DOCUMENTS

2021/0003332 A1* 1/2021 Nakagawa ..... F25B 43/003
2023/0096259 A1* 3/2023 Nalamwar ..... F25B 49/02 62/238.7
2024/0125519 A1* 4/2024 Taras ..... F25B 49/02

FOREIGN PATENT DOCUMENTS

CN 112503811 A * 3/2021 ..... F25B 30/02
CN 113776220 A * 12/2021

OTHER PUBLICATIONS

Pdf is translation of foreign reference CN-112503811-A (Year: 2021).*
Pdf is translation of foreign reference CN 113776220 A (Year: 2021).*

* cited by examiner

*Primary Examiner* — Henry T Crenshaw
*Assistant Examiner* — Kamran Tavakoldavani

(57) ABSTRACT

An add-on apparatus for improving the overall efficiency of a conventional air-source air conditioner or air-source heat pump is disclosed. The add-on apparatus is a combination of piping and at least one controllable valve that provides fluid and electric or electronic control communication between the host receiving air conditioner or heat pump piping circuit and a discretionary interacting energy exchange means. The add-on apparatus having connecting refrigerant gas piping and connecting refrigerant liquid piping for communicating fluids between the host and interacting energy source. The electric or electronic communication can employ self-teaching software and have the ability to override a conventional air conditioning or heat pump control system.

4 Claims, 16 Drawing Sheets

ADD-ON APPARATUS FOR CONVERTING A CONVENTIONAL AIR-SOURCE REFRIGERATION CYCLE FOR MULTIPLE HEAT TRANSFER OPTIONS

BACKGROUND OF THE INVENTION

1. Field of the Invention

In general, the present invention relates to providing a means to modify conventional refrigeration equipment. More particularly, the present invention relates to retrofit add-on methods for modifying and enabling an air-source air conditioner or heat pump mechanically, electrically, and electronically to allow the adaptation of multiple sustainable high and low energy sources for reducing seasonal watt consumption.

2. Prior Art Description

The conceptual development of a refrigeration system using a two-phase compressible refrigerant fluid was in the 1804. The system included a single closed loop piping and component circuit comprising a vapor compressing means, two means of heat transfer, and a fluid expansion means to alter high pressure liquid into low pressure gas. In this single closed loop system heat from inside a space transferred into the refrigerant in one heat exchange device conventionally known as an evaporator coil and allowing this heat to be expelled from a second heat exchange device conventionally known as a condensing coil into the exterior surrounding environment. This simple single loop based on the theoretical Carnot Cycle remains the basic process where ambient air surrounding both indoor and outdoor heat exchange devices transfer energy to and from these devices. Improvements to and applications for the basic single loop design have taken place. In the 1940s manufacturers using improved phase change refrigerants and components introduced air-source air conditioning systems to residences and light commercial buildings. In the 1950s these same manufacturers introduced a component to this single loop cycle identified as a reversing valve. By doing so, high pressure and temperature gas from a compressor could be discharged through the otherwise evaporator coil making it a condensing coil and conversely otherwise condensing coil becomes the evaporator coil. An additional requirement is the thermal expansion device conventionally identified as a thermal expansion valve, or TXV, must be reversible as well leading to the development of two directional TXVs that include an internal check valve. The term "split" is used in the art to identify an air conditioning or heat pump that has two distinct cabinets (split) with common high and low pressure tubing where the cabinets are thus separated by distance. A "Package" system is installed as one cabinet.

A more recent development in air-source air conditioners and heat pumps are conventionally identified as mini-splits that provide multiple indoor heat transfer coils and a single outdoor heat exchange coil. This type system relies on refrigerant gas and liquid manifolds at the inlet of the compressor and at the outlet of the outdoor coil to accommodate multiple indoor heat transfer coils.

Air-source air conditioning and heat pump systems remain the conventional approach to cooing and, with a heat pump, heating of a residence or light commercial building using lower capacity systems. Well over 95% of all residential installed systems are split air-source and are dependent for the transfer of energy between ambient and inside space conditions. With fossil fuels being reduced worldwide at some levels for space heating, the least costly alternative will continue to be the installation of heat pumps as electrification policies increase.

Air-source cooling and heating cycles rely on differential air and refrigerant temperatures during heat exchange. The greater the temperature differential ($\Delta T$) across a heat exchange device, the more effective the heat exchange of energy. The compressor discharges high temperature gas that creates the $\Delta T$ necessary for heat exchange to exterior ambient air. Watts of electrical energy consumed by the compressor increases significantly in order to create a higher $\Delta T$ increase as external ambient temperatures increase. The ratio between the efficiency of heat exchange and watts consumed is defined as the coefficient of performance (COP). When indoor temperature demand and outdoor temperatures are near the same, the greatest differential temperatures can be achieved for the least amount of watts consumed. Theoretically, as outdoor ambient temperatures drop the COP will continue to improve. Limitations are set by manufacturers of systems and refrigerants as to the maximum COP. Conversely, in a heat pump cycle, theoretically, lower ambient daily temperatures would result in a higher COP. This is not practical as temperatures drop during the winter the available energy in the air drops as well. A compressor will run for longer periods to draw energy from the outside on a cold day. Manufacturers compensate for this by adding electric heating strips which do not have the advantage of latent phase-change energy transfer. An air-source refrigeration system draws significantly more watts to operate in a cooling and heating cycle due to summer high temperatures and winter low temperatures. Additionally, a cycle could increase in efficiency if software controls were applied to lower condensing coil temperatures below ambient in the summer and increasing evaporator coil temperatures above ambient in the winter. With higher energy costs due in part to population growth and available electric energy sources, the limitations of air-source cooling and heating have led to greater public awareness of utility costs and summer and winter blackout concerns.

Since the 1970s patents have been issued disclosing the application of waste heat to improve air-source cycle effectiveness or the addition of heat or cool from other than air to aid in improving cycle efficiency. USPTO U.S. Pat. No. 4,386,500, for example, discloses a conversion kit to utilize heat rejected from an air conditioner condensing coil to aid in the heating of domestic water. The disclosure does not consider a heat pump or efficiency control in applying the conversion kit. Additionally, the disclosure does not anticipate methods to enable multiple heat exchange. The disclosure does provide the direction currently displayed in recent patents that disclose methods to increase efficiency by providing hot or cold energy sources. These more recent disclosures, however, include complex systems not practical for residential and light commercial applications. One such disclosure is USPTO publication 2009/0288430 in which a complex method of energy storage is shown coupled to a heat pump arrangement. This disclosure limits discretionary heat exchange. An additional disclosure of complex prior art is USPTO U.S. Pat. No. 8,726,682 which discloses a water source heat pump dependent on described sources of energy not including air-source heat exchange. Within this disclosure a liquid is pumped through two separate energy sources by valving and pumping arrangements to transfer heat or cold to and from a liquid to refrigerant heat pump. The liquid has non-reversible flow initiated by one of two pumps which then can be valved through the two separate energy sources in two directions. A drawback of this disclosure is the complexity of a separate liquid piping and valving circulation system that eliminates other discretionary heat exchange options.

Other disclosures and products exist in the public domain that demonstrate a simple approach to improving the efficiency of an air-source air conditioner or heat pump in either improving cooling efficiency or heating efficiency. For example, one uses a refrigeration-to-liquid heat exchange to use swimming pool water to improve the efficiency of the compressor discharge condensing efficiency in the cooling mode of an air conditioner or heat pump. This is a single direction refrigerant flow system using a 3-way valve and simple analog controls. Another example, is a system that adds heat to compressor discharge gas through a solar thermal loop to increase thermal energy. By using a variable speed compressor, the manufacturer claims the solar boost allows the compressor to operate at a lower speed increasing efficiency.

What is needed, therefore, is an add-on conversion apparatus with interconnecting piping, valving, and control system for converting conventional air-source refrigeration systems into those having a broad range of heat transfer sources and methods. What is also needed is a conversion refrigeration circuit in a grouped arrangement that is controlled reactively and proactively through use of self-teaching and self-diagnostic software. Still further needed is a compact modular apparatus that can be housed internally or externally to an air conditioning or heat pump system.

SUMMARY OF THE INVENTION

Generally, air-source air conditioners and heat pumps are the conventional standard for cooling and heating residencies, commercial businesses, industrial buildings, and other spaces requiring environment temperature control. Manufacturers of these systems have under regulations increased the efficiency of these systems to meet minimum watt consumption requirements. Air-source refrigeration systems meet these requirements by using moderate ambient temperature conditions as a baseline. The maximum efficiency therefore results when indoor and outdoor temperatures are near the same. Outside these conditions, efficiency drops requiring higher watt consumption. In the cooling cycle as with both an air conditioning and heat pump systems high outdoor temperatures in some geographical regions requires the compressor to operate at higher wattage to create sufficient differential temperatures for adequate heat transfer. Conversely, during the winter months in some geographical areas while the compressor would not draw greater wattage, however, the compressor would run longer and heat is augmented by direct electric heat increasing the overall watts consumed. The present invention provides the means of adding interconnecting piping to a host refrigeration cycle to access auxiliary high efficiency heat exchange capability at the site of installation at the discretion of the installer and user for the geographic region the system is located. By doing so, the initial system capacity can be lower than typically sized as these systems are sized for peak summer or winter conditions. Further the present invention features levels of reactive and proactive controls. Users in cooler climates may install or access higher temperature sources and methods while, conversely, users in warmer climates may install or access lower temperature sources and methods.

Generally, the subject matter of the present invention may include active or passive refrigerant fluid valves set in an interconnecting configuration to initiate heat exchange by directing refrigerant flow separately from and to a conventional host refrigeration circuit through a separate interconnecting gas piping and valve circuit and an interconnecting liquid piping and valve circuit. This is accomplished, in part, by sensing the operating conditions of the primary or host receiving circuit. Depending on the availability of optional external thermal sources to increase efficiency, and independent of the air source refrigeration cycle, electrically controlled valves within an interconnecting configuration will open or close. Any check valves within this configuration will open or close depending on the direction of refrigerant flow created by a compressor within the host refrigeration circuit.

Generally, the present invention, therefore, is the application of current and future refrigeration actively controlled valves through the use of software and firmware that achieves anticipated watt reduction results.

Generally, refrigerant flow valves are manufactured to meet market demand for multiple applications. Existing valves are used primarily in commercial and industrial applications. They are rated for the direction of flow, amount of flow, pressures, and amount of pressure change across a valve. Valves are manufactured with varying types of electric or electronic power supplies. These actuatable valves include: proportional valves, 3-way valves, 2-way valves, and 2-way piloted valves. There are also 1-way single directional passive check valves used in refrigerant flow applications.

Valve application 1: The present invention is configured to provide normally open valves within the host receiving circuit to insure default gas refrigerant flow should the electric power be lost to the present invention.

Valve application 2: The present invention is configured to provide normally closed valves in the interconnecting piping circuits.

Valve application 3: In the present invention, by using multiple actuatable valves, control software can alter the opening and closing of these valves with timed delays to eliminate velocity flow shock to the compressor and other valves.

Manufacturers of air conditioning and heat pumps design all components including valves in a circuit for mass flow and heat exchange balance for their SEER ratings and performance. The present invention anticipates the same mass flow and heat exchange balance within the interconnecting circuits and interacting energy sources as a part of this disclosure.

According to aspects of the present invention, an interconnecting liquid and gas refrigeration circuit that is interconnected to a host air-source air conditioning or heat pump refrigeration single loop circuit within the high pressure gas section of the circuit, within the low pressure gas section of the circuit, and within the high pressure liquid section of the host receiving circuit.

According to some aspects, an interconnecting liquid and gas refrigeration circuit that enables unimpeded refrigerant flow in reversing directions through the host refrigeration circuit when the interconnecting circuit is idle.

According to some aspects, an interconnecting liquid and gas refrigeration circuit that may enable reversing refrigerant flows through an interface energy exchanging system.

According to some aspects, an interconnecting liquid and gas refrigeration circuit that may enable reversing refrigerant flows through multiple interface energy exchanging systems.

According to some aspects, an interconnecting liquid and gas refrigeration circuit that may enable reversing refrigerant flows through a terminating energy exchanging system.

According to some aspects, an interconnecting liquid and gas refrigeration circuit that may enable a refrigerant-to-liquid high and low energy transfer system.

According to some aspects, an interconnecting liquid and gas refrigeration circuit that may enable a refrigerant-to-air high and low energy transfer system.

According to some aspects, an interconnecting liquid and gas refrigeration circuit that may enable a refrigerant-to-solid high and low energy transfer system.

According to some aspects, an interconnecting liquid and gas refrigeration circuit that may enable a refrigerant-to-phase change high or low energy transfer system.

According to some aspects, an interconnecting liquid and gas refrigerant piping circuit may be connected to a host receiving refrigerant piping internally or externally to a split system condensing cabinet.

According to some aspects, an interconnecting liquid and gas refrigerant piping circuit may be connected to host refrigerant piping internally or externally to a packaged air conditioning or heat pump cabinet.

According to some aspects, an interconnecting liquid and gas refrigerant piping circuit may be housed within a separate external enclosure.

According to some aspects, an interconnecting liquid and gas refrigerant piping circuit may provide accessible and serviceable connecting points.

According to some aspects, an interconnecting liquid and gas refrigerant piping circuit may have reactive on-demand controls.

According to some aspects, an interconnecting liquid and gas refrigerant piping circuit may have proactive controls to override host system controls.

According to some aspects, an interconnecting liquid and gas refrigerant piping circuit may communicate with diagnostic software to override host system controls.

According to some aspects, the temperature difference between ambient and thermal sources may determine the open or closed position of multiple valves in both the host and interconnecting liquid and gas piping.

According to some aspects, temperature and time over a multi-hour period will determine the position of actuatable valves and the fluid flow direction of the host and interconnecting liquid and gas refrigeration circuits.

According to some aspects, all actuatable valves will default to the host receiving piping circuit.

According to some aspects, interconnecting circuit controls respond to an indoor binary thermostat signal.

According to some aspects, interconnecting circuit controls respond to an indoor proportional thermostat signal.

According to some aspects, a signal is provided from a reversing valve solenoid signal to initiate heating mode conditions for the interconnecting circuit controls.

According to some aspects, a signal is provided from a reversing valve solenoid signal to initiate cooling mode conditions for the interconnecting circuit controls.

According to some aspects, the controls for the host and interconnecting piping circuits and components are stand alone.

According to some aspects, the controls for the host and interconnecting piping and components interface with other electrical, electronic, and control software.

According to some aspects, the controls for the host and interconnecting piping components are initiated by artificial intelligent self-learning software.

According to some aspects, the parameter controls for the host and interconnecting piping components are controlled by manual input from computer, smart phone, or similar device.

According to some aspects, refrigerant check valves may be used.

According to some aspects, refrigerant actuatable valves may be used.

According to some aspects, refrigerant shut off valves may be used.

According to some aspects, refrigerant sight glasses may be used.

According to some aspects, refrigerant high pressure relief valves may be used.

According to some aspects, a refrigerant accumulator may be used.

The present invention fully anticipates advances in heat transfer devices, energy absorption and dissipation technologies, and energy storage systems. The present invention is configured to adapt to an air-source air conditioning or heat pump system using current and future valve types, sizing, controls, and mass flow rate modifications that may change as required to meet codes, standards, and new technology.

The details of one or more variations of the subject matter described herein are set forth in the accompanying drawings and the description below. Other features and advantages of the subject matter described herein will be apparent from the description and drawings, and from the claims. The claims that follow this disclosure are intended to define the scope of the protected subject matter.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
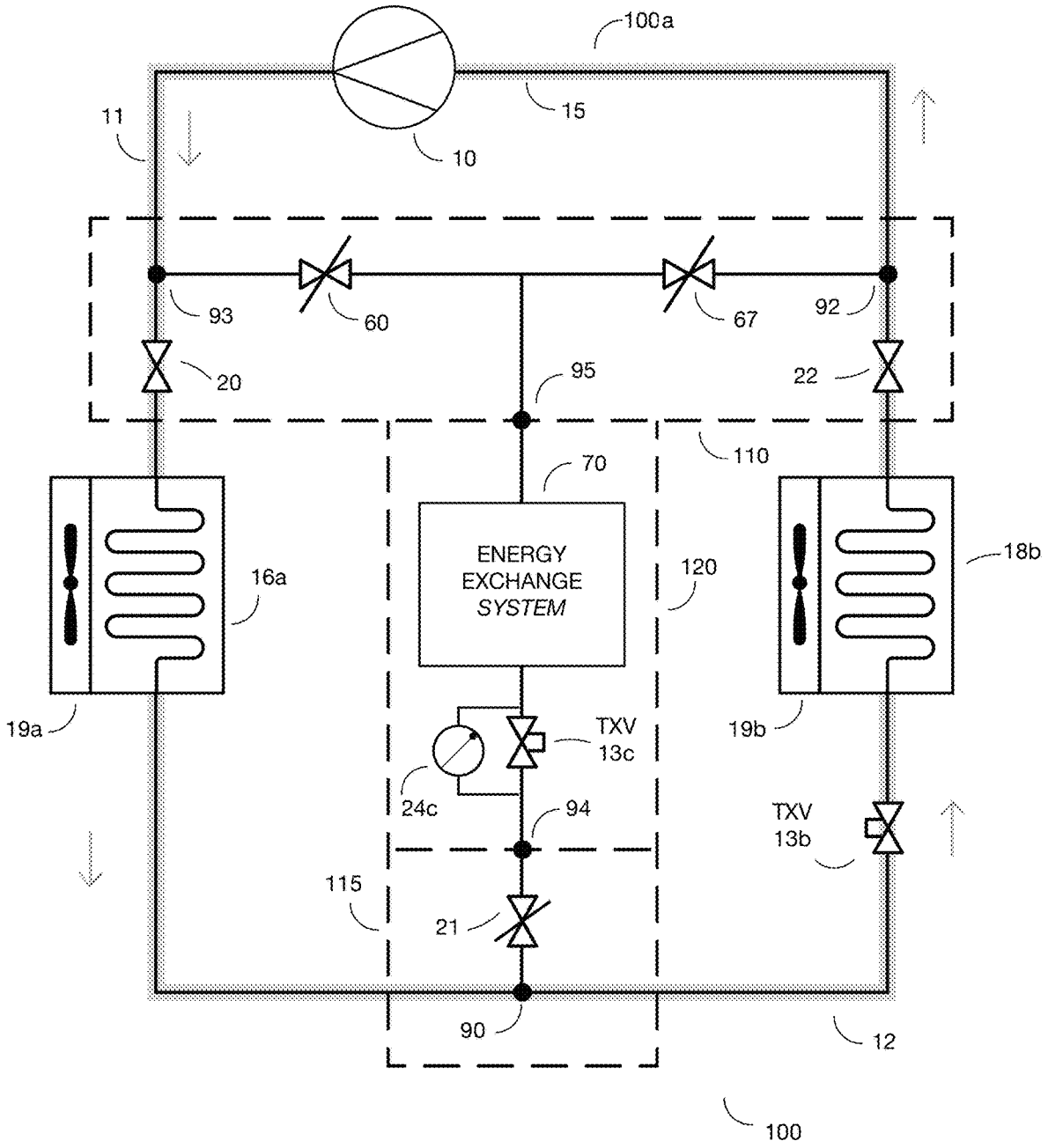
FIG. 1 is a schematic of a host receiving and interconnecting refrigeration circuit of an air conditioning system in default cooling mode.

The present invention for converting air-source air conditioners and heat pumps for enabling of additional methods of heat transfer can be embodied by many methods. The following embodiments illustrated show only some of the exemplary systems and a number of variations of its advantage. These embodiments are selected in order to set forth the best modes contemplated for the invention. The illustrated embodiments should not be considered a limitation when interpreting the scope of the appended claims. Terms primary or host receiving circuit may be used interchangeably for the purpose of clarity when describing an air conditioning or heat pump piping system. Terms temperature, heat, energy, and energy exchange are used interchangeably for the purpose of clarity when describing a source of cold or hot. Indoor refers to an environmentally thermostatically controlled space and outdoor refers to an external environment of the controlled air conditioner or heat pump components.

In order, therefore, to best describe the following figures is to first review components of air-source air conditioners and heat pumps by comparing the two conventional systems and their components. Both an air conditioner and a heat pump have four major components: a compressor, a condensing coil, an evaporator coil, and a thermostatic expansion valve (TXV) which has a high pressure liquid throttling function. A manufactured TXV may be one-directional or two-directional with a built-in reversinq check valve. A TXV may respond to a gas temperature sensor bulb or be electronically controlled. There is only one TXV (one-directional) used in an air conditioning (cooling only) system as refrigerant flows in one direction. In a heat pump, however, there are two two-directional TXVs as heat pumps have two-directional refrigerant flow. This is a necessity as a heat pump requires the use of a gas flow reversing valve adjacent to the compressor which allows the condensing coil and the evaporator coil to reverse their heat exchange function. A heat pump, therefore, utilizes a conventional reversing valve at the outlet of the compressor to control gas flow direction. No other conventional valving is required within these two systems. The present invention is indicated by 100 in the figures that follow.

In the following figures an air conditioner is referred by 100*a* and a heat pump is referred by 100*b* and are both identified as the host receiving circuit. Any numbers referred by 90-99 are connecting points within the host receiving circuit, interconnecting circuit 110 and 115, and the hot or cold energy source 120. For brevity, valves 20 and 22 are shown within the host receiving circuit in FIGS. 1-9. FIGS. 10*a* and 10*b* show the preferred connecting embodiment for the group valve conversion module in FIGS. 11*a* and 11*b*. In FIGS. 1-9 the host fluid in 11 and 15 is always a gas and host fluid in 12 is always a liquid. For purposes of clarity and brevity the following FIGS. do not schematically show a mini-split system as anyone trained in the art can see the advantages of the present invention applied to these systems without showing the complexity of their piping requirements. It is to be understood by the reader knowledgeable in the art that the present invention is an add-on retrofit apparatus to be installed by a technician on-site in the field. It is to be also understood that the technician may make modifications in a separate location to a compressor cabinet and piping, as well as, to the apparatus thermoexpansion valve prior to field installation. Best practice requires all TXVs have identical methods of controlling refrigerant flow. Bulb versus electronic control, for example.

The term controller is used throughout the following FIGS. as the method used to activate and deactivate valve actuators and motors. A controller being an electric powered device that with software and firmware operates electronic and electric components within the described fluid circuits.

Now referring to FIG. 1 specifically, a conventional air conditioner default flow path is shown in cooling mode with a board line with arrows depicting the flow path direction. Hot gas is discharged into piping 11 through connecting point 93 and normally open (NO) 2-way solenoid valve 20 before entering condensing coil 16*a*. Condensed refrigerant 12 flows through connecting point 90 to one-directional TXV 13*b*. Refrigerant liquid flashes into a low pressure gas creating a cold sink in the evaporator where heat is absorbed. The low pressure gas flows through NO 2-way solenoid valve 22 and connecting point 92 in piping 15 returning to compressor 10. Mechanical fans 19*a* and 19*b* operate to aid the transfer of heat. Under conventional cooling operation, both fans will always operate. Optimum cooling occurs when outdoor ambient temperature conditions exist near the indoor thermostat setting allowing the cycle to operate at its peak manufactured COP and accessible cold sources are warranted.

Figure 2:
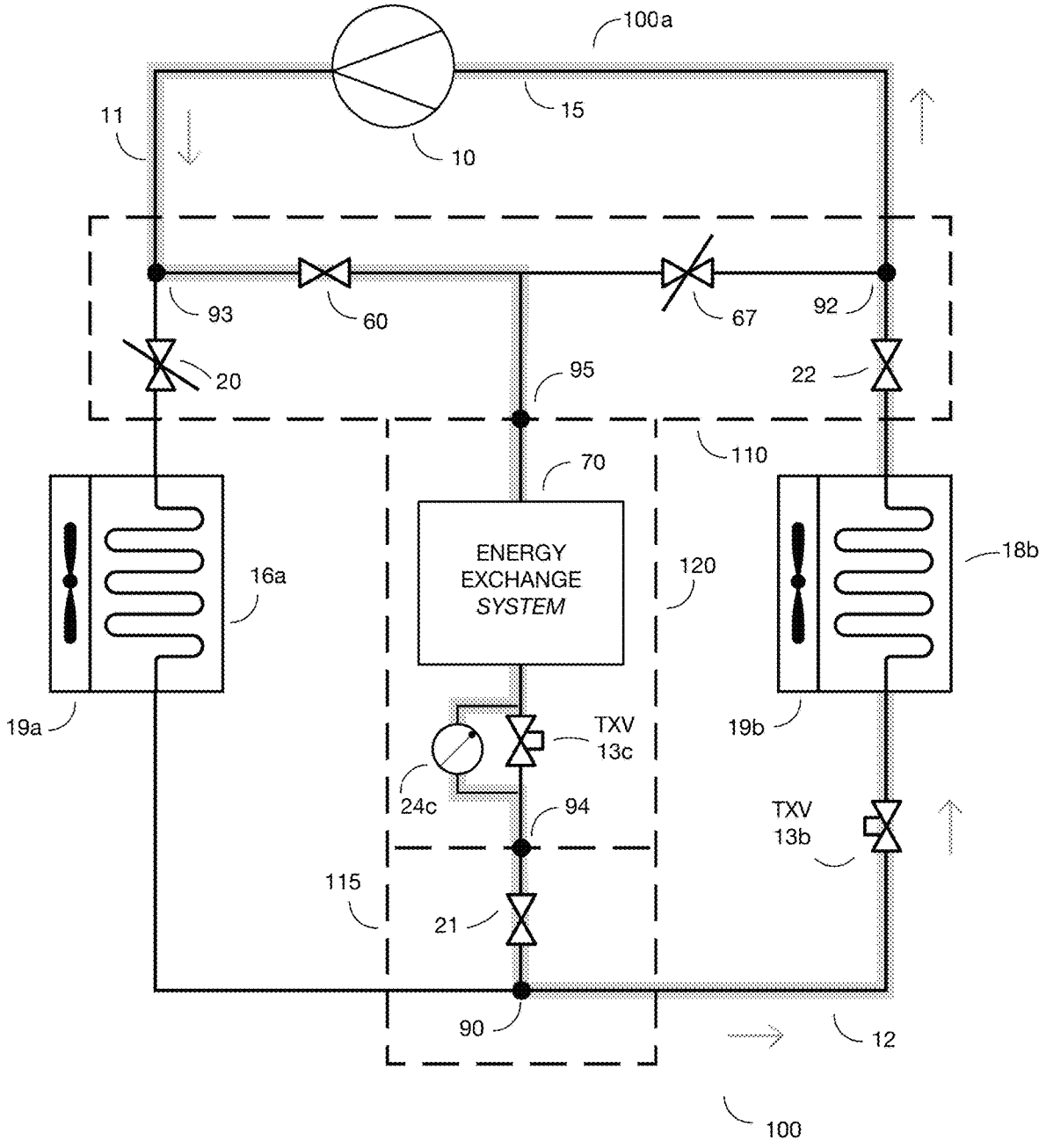
FIG. 2 is a schematic of a host receiving and interconnecting refrigeration circuit of an air conditioning system in on-demand cooling mode employing an interacting energy exchange system.

In FIG. 2, outdoor ambient temperature conditions are above optimum. A controller means controller determines that within an interacting energy source 120 a cold condition exists accessible through Energy Exchange System (EES) 70. The controller changes the default cycle to access this cold condition for improving COP. Hot refrigerant gas leaves compressor 10 through piping 11 to interconnecting point 93. NO valve 20 closes and normally closed (NC) valve 60 opens allowing hot gas to pass through connecting point 95 reaching EES 70. EE 70 may be an interfacing heat exchanger or a terminating heat exchanger. The source of cold may be on-demand or from a stored source. Examples of the cold condition may be, but not limited to, ground, water, heat dissipating daytime sky systems, or a cold storage means. Therefore, the source of cold becomes a condenser for the hot gas. Within the interacting energy source 120 and as an integrated part of EES 70 is a 2-way TXV allowing the now #et condensed liquid to flow through check valve 24*c* leaving interacting energy source 120 at point 94 and now entering interconnecting liquid circuit 115 through opened NC valve 21 and connecting point 90. The condensed liquid enters evaporator coil 18*b* as it did in FIG. 1 through one-directional TXV 13*b*. The now low pressure gas flows through NO valve 22 and connecting point 92 in interconnecting gas circuit 110 back through piping 15. NC valve 67 remains closed. The controller shuts off mechanical fan 19*a*, however, mechanical fan 19*b* operates normally to indoor thermostat set points.

Figure 3:
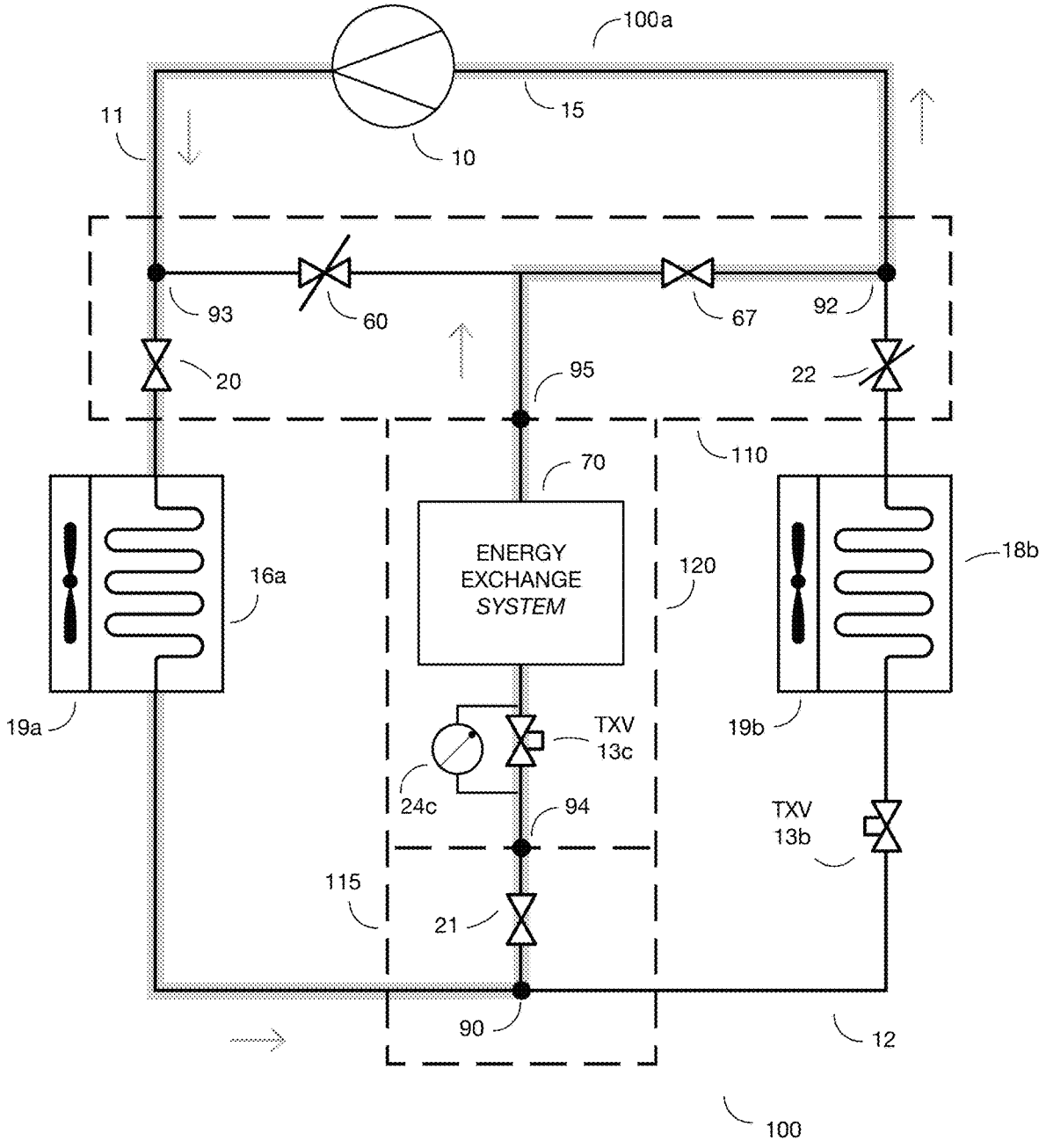
FIG. 3 is a schematic of a host receiving and interconnecting refrigeration circuit of an air conditioning system in proactive pre-cooling storage mode employing an interacting energy exchange system and storage source.

Throughout the cooling season, night and early morning outside ambient temperatures are closer to conditions for maximum system efficiency. Thus operating an air conditioning system during this time will increase the COP of a system compared to operation during peak heat periods. FIG. 3 takes advantage of this condition for applications where an energy storage system is utilized to create a cold condition with night sky heat dissipation, for example. With this example, high efficiency cooling from an energy storage system can be achieved by accessing a cold source for the system heat exchange when outside ambient air temperatures peak. A controller initiates compressor 10 start independent of the indoor thermostat. Valves 20, 21, and 67 are controlled open through gas connecting point 93 while valves 60 and 22 are controlled closed. Hot gas flows through condensing coil 16*a*, however, the resulting hot liquid is routed through connecting points 90 and 94, TXV 13*c*, and EES 70 providing accessible cooling to an energy storage system. Low pressure gas returns to the compressor 10 through interconnecting piping 110 and connecting points 95 and 92. In this example condensing coil fan 19*a* operates while supply air fan 19*b* does not. The indoor thermostat does not control host cycle operation.

Figure 4:
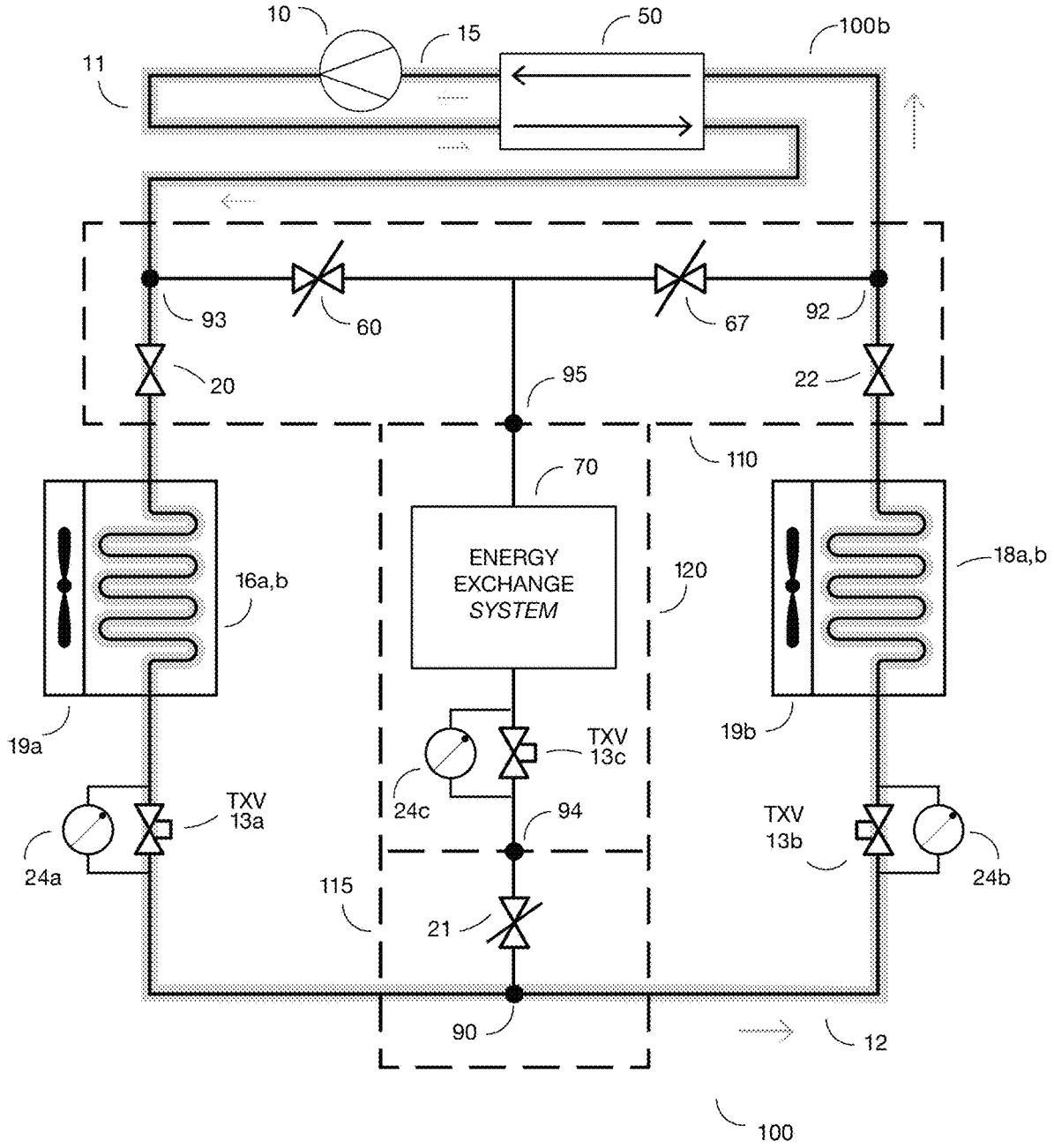
FIG. 4 is a schematic of a host receiving and interconnecting refrigeration circuit of a heat pump system in default cooling mode.
Figure 5:
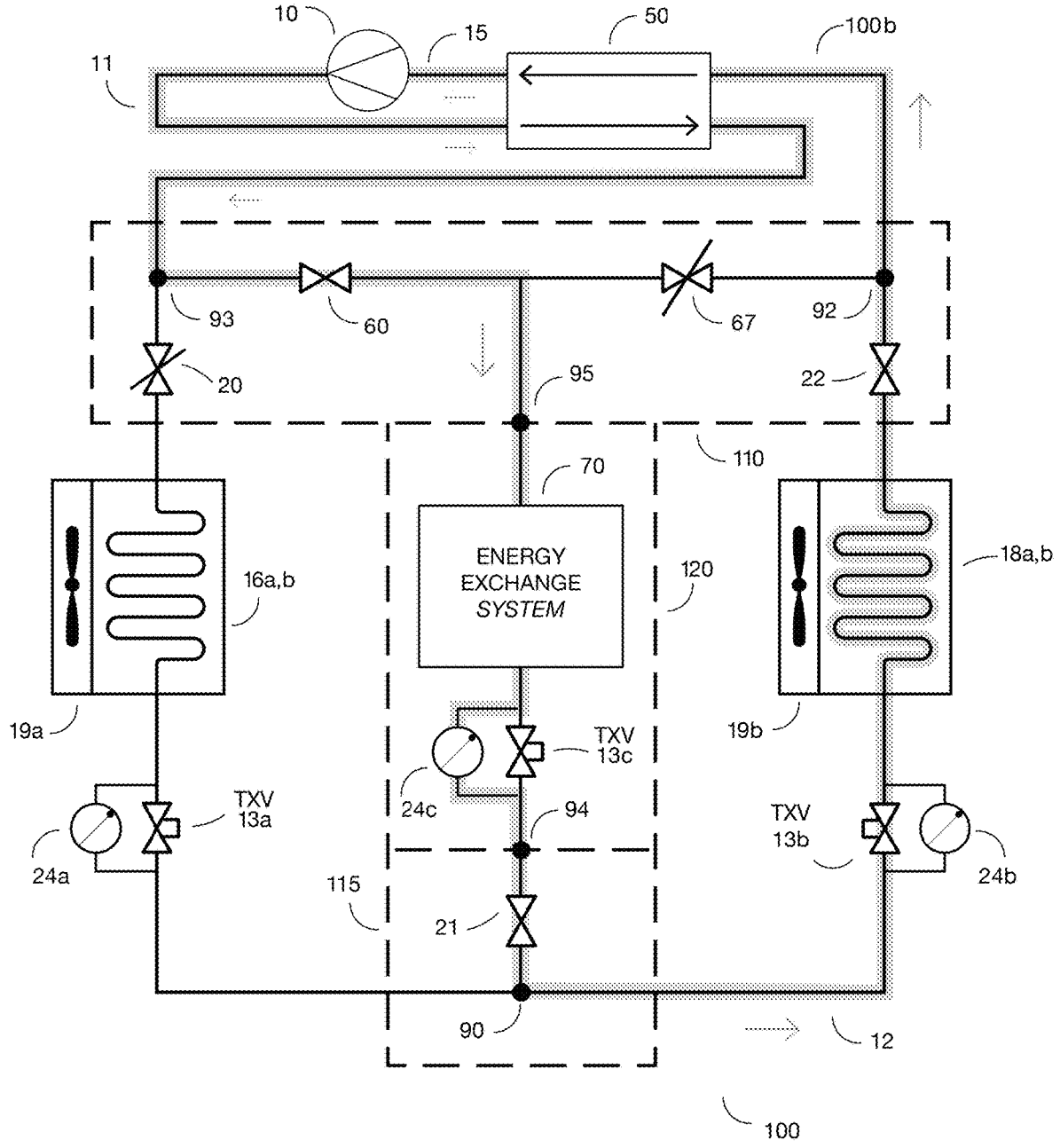
FIG. 5 is a schematic of a host receiving and interconnecting refrigeration circuit of a heat pump system in on-demand cooling mode employing an interacting energy source system.
Figure 6:
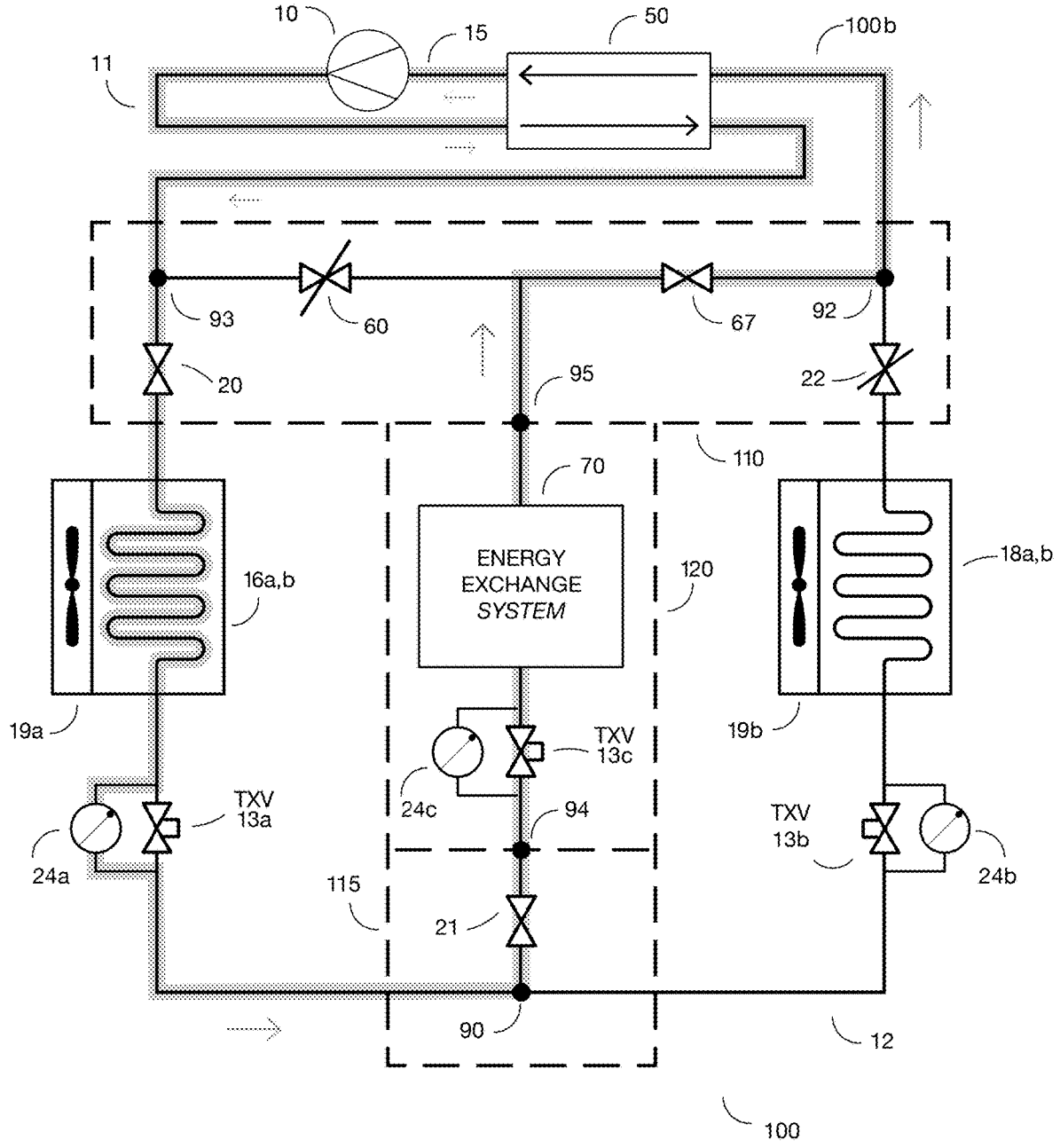
FIG. 6 is a schematic of a host receiving and interconnecting refrigeration circuit of a heat pump system in proactive pre-cooling storage mode employing an interacting energy exchange and storage source.

FIGS. 4, 5, and 6 are schematics of a heat pump in cooling mode. Additional components are required in a heat pump relative to FIGS. 1, 2, and 3. Reversing valve 50, TXV 13*a*, and check valves 24*a* and 24*b* are required to complete the cycle allowing both cooling and heating modes. Reversing valve 50 is a conventional device that is controlled by an indoor thermostat to determine the mode of operation. Therefore, the flow paths and valve operation shown in FIGS. 1, 2, and 3 are shown again in FIGS. 4, 5, and 6.

Figure 7:
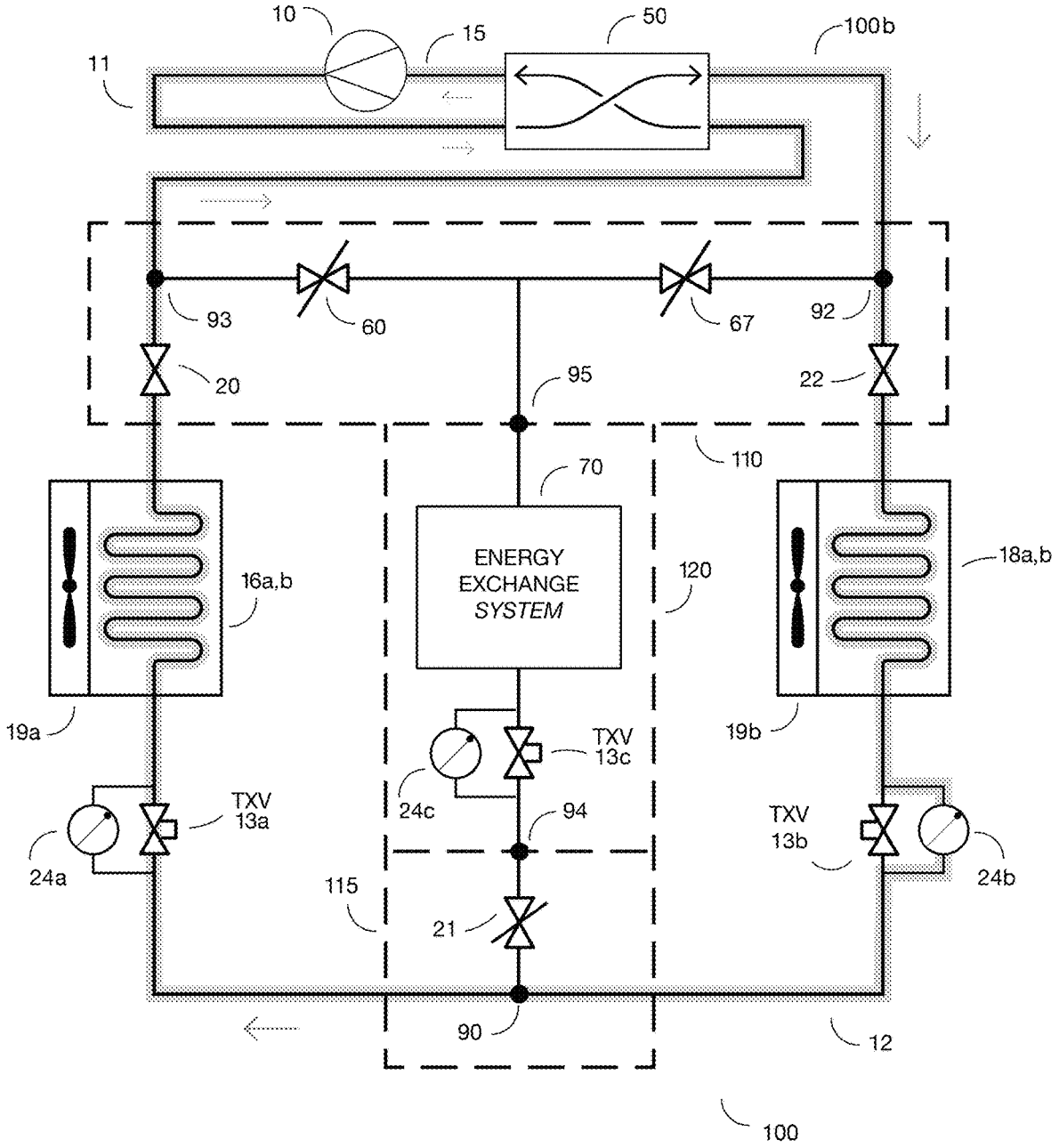
FIG. 7 is a schematic of a host receiving and interconnecting refrigeration circuit of a heat pump system in default heating mode.

FIG. 7 is a schematic of a heat pump in default heating mode. Default heating mode takes place during seasonal periods when an indoor thermostat calls for heating and the outside ambient air temperature is optimal for the highest manufactured COP of the season and auxiliary heat sources are not available. Compressor 10 discharges hot gas through host piping 11 and reversing valve 50 through point 92 and NO valve 22 to the now condensing coil 18*b* where heat is released indoors via mechanical supply air fan 19*b*. Condensed liquid refrigerant is provided a flow path through check valve 24*b* through connecting point 90 and TXV 13*a* and now outdoor evaporator coil 16*b*. Evaporator coil 16*a* absorbs available heat from outdoor ambient air with the aid of mechanical air fan 19*a*. The now low pressure refrigerant gas flows through NO valve 20 and connecting point 93 into return suction piping 15. In this default example, NC valves 21, 60, and 67 remain closed.

Figure 8:
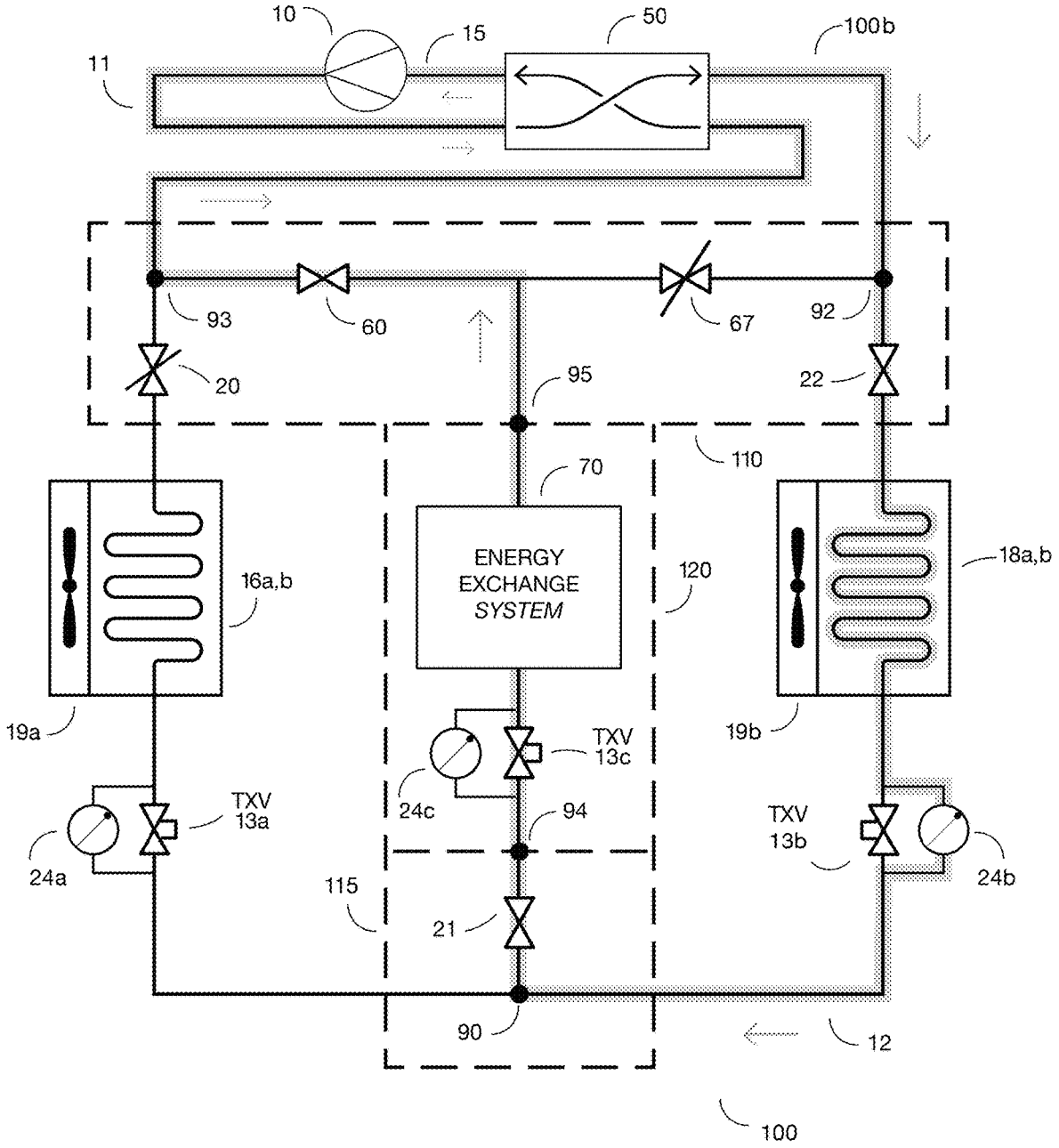
FIG. 8 is a schematic of a host receiving and interconnecting refrigeration circuit of a heat pump system in on-demand heating mode employing an interacting energy source system.

FIG. 8 is a schematic of a heat pump accessing energy from an accessible heat source. This energy source can be from either an on-demand or from a stored energy source. On-demand examples are hot water solar or heat build-up in an attic. Hot gas is discharged from compressor 10 through reversing valve 50 directing the gas through connecting point 92 and NO valve 22. As with a conventional heat pump gas is condensed within coil 18*b* releasing heat into an indoor space using mechanical supply fan 19*b*. Hot liquid flows from condenser 18*b* through check valve 24*b* to connecting point 90. The hot liquid is routed through opened NC valve 21 and interacting TXV 13*c* and EES 70. The condensed liquid boils under low pressure absorbing heat from an auxiliary source and returning through connecting point 95, opened NC valve 60, and connecting point 93. The low pressure gas returns to compressor 10 via suction pipe 15 through reversing valve 50. Valves 67 and 20 are controlled closed. Mechanical air fan 19*a* is idle.

Figure 9:
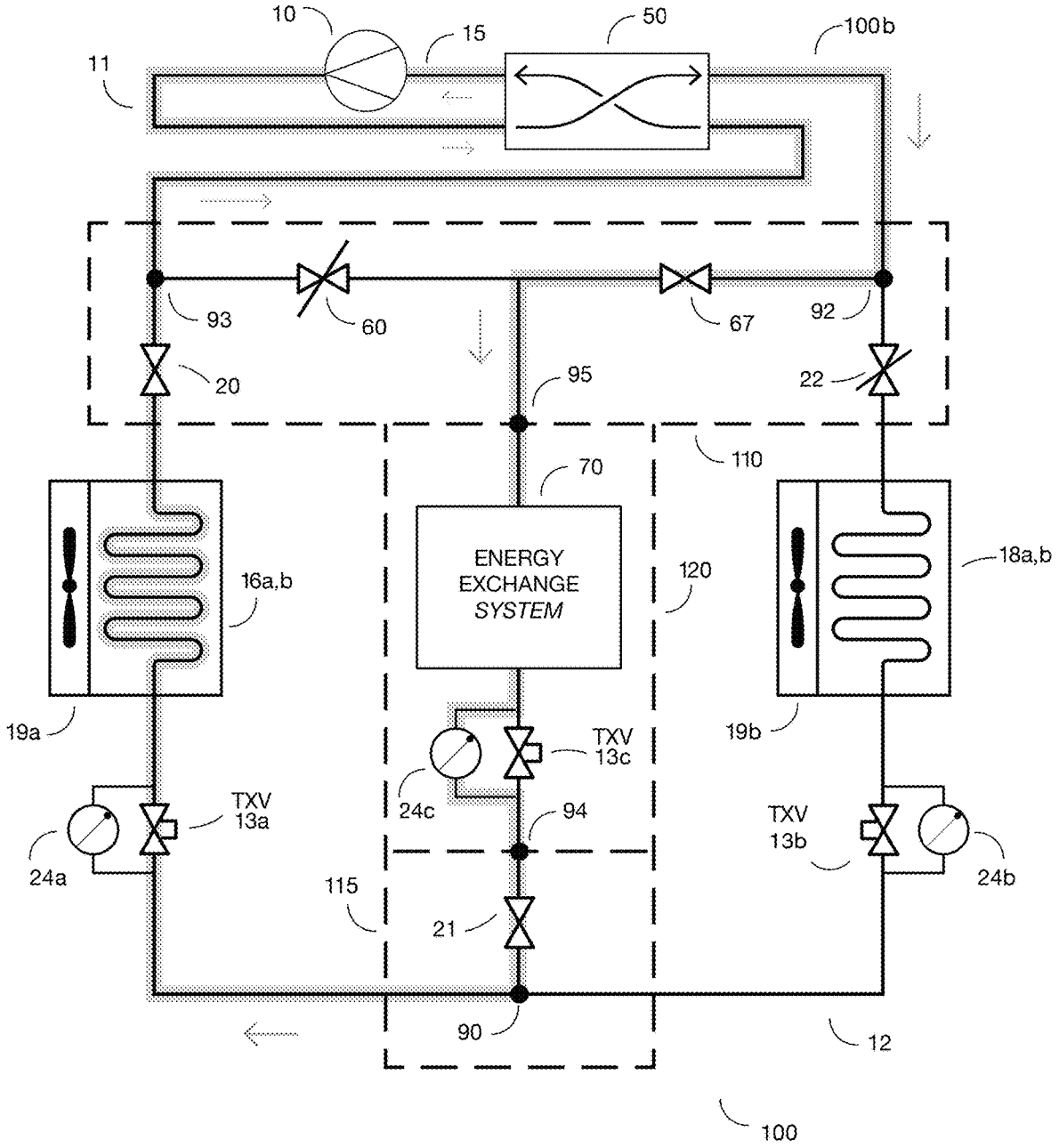
FIG. 9 is a schematic of a host receiving and interconnecting refrigeration circuit of a heat pump system in proactive pre-heating storage mode employing an interacting energy exchange and storage source.
Figure 10A:
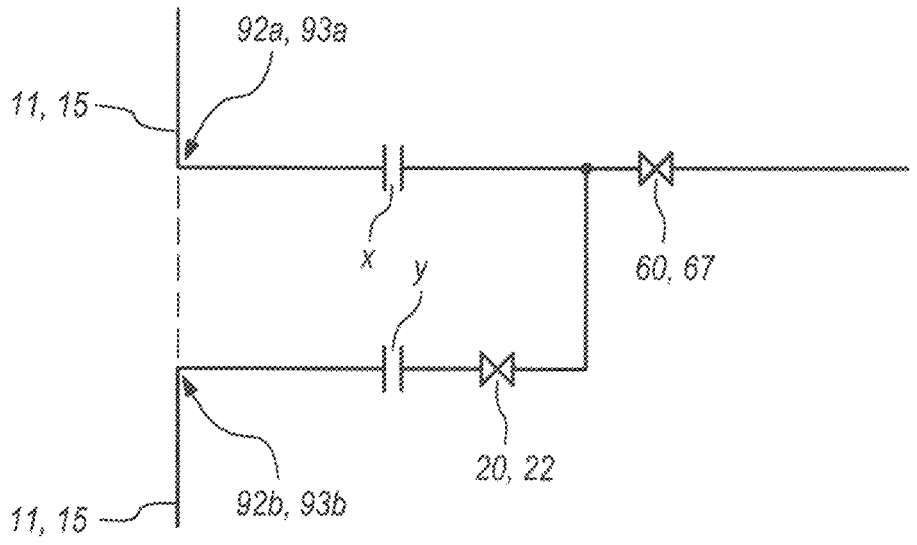
FIG. 10*a* is a schematic of the preferred arrangement of connecting points and valves for the interconnecting piping with gas flow.
Figure 10B:
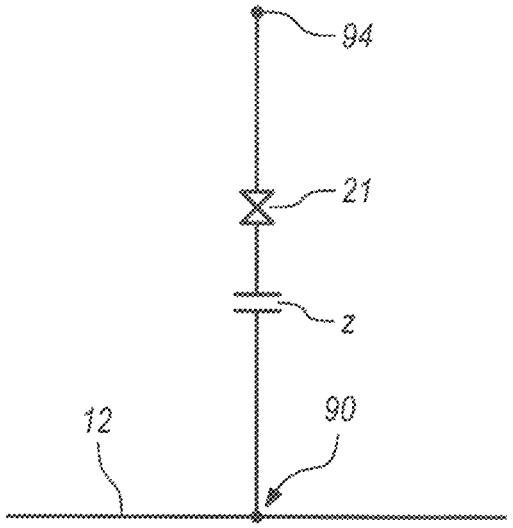
FIG. 10*b* is a schematic of the preferred arrangement of connecting point and valve for the interconnecting piping with liquid flow.

FIG. 9 provides a means to capture and store heat from ambient air or other heat sources for accessibility by the interconnecting circuits 110 and 115 at a later period of a day. In this schematic circuits 110 and 115 controller overrides an indoor thermostat or other controls for the heat pump to allow for compressor 10 operation for energy storage only. For example, absorbing energy during daylight hours during the winter for accessibility at night when outside ambient temperatures are at the lowest. This method will operate compressor 10 when the COP is the highest. Hot gas is discharged from compressor 10 through piping 11 and is directed through reversing valve 50 to connecting point 92, through interconnecting piping circuit 110 including opened NC valve 67 and connecting point 95. The hot gas is condensed in EES 70 dissipating heat into a storage medium. Hot liquid flows through check valve 24*c* and reentering interconnecting circuit 115 at point 94, through opened NC valve 21, and to connecting point 90. The hot liquid flows through TXV 13*a*, evaporating coil 16*b*, NO valve 20, and connecting point 93 before returning through reversing valve 50 and suction piping 15. NO valve 22 is closed and NC valve 60 remains closed. Mechanical fan 19*b* is idle.

FIGS. 10*a* and 10*b* are details of the preferred embodiment as it relates to the connecting of interconnecting piping and valve circuits 110 and 115 to host receiving circuits 100*a* or 100*b*. In FIG. 10*a* gas lines 11 or 15 are shown with a piping elbow at point 92*a* or 93*a* and a piping elbow at 92*b* or 93*b* for interconnecting piping and valve circuit 110. The dashed line represents 11 or 15 prior to being intercepted at point 92 or 93. At the point of manufacture rather than a field installation, the dashed line would not be included should a manufacturer provide a factory installed shut-off bypass valve configuration. The break lines x and y represent a possible distance between the host receiving circuit and the interconnecting gas circuit. FIG. 10*b* liquid line 12 is shown with a pipe tee at point of interception at location 90. At the point of manufacture rather than a field installation, a tee may be included. Break line z represent a possible distance between the receiving circuit and the interconnecting liquid circuit.

Figure 11A:
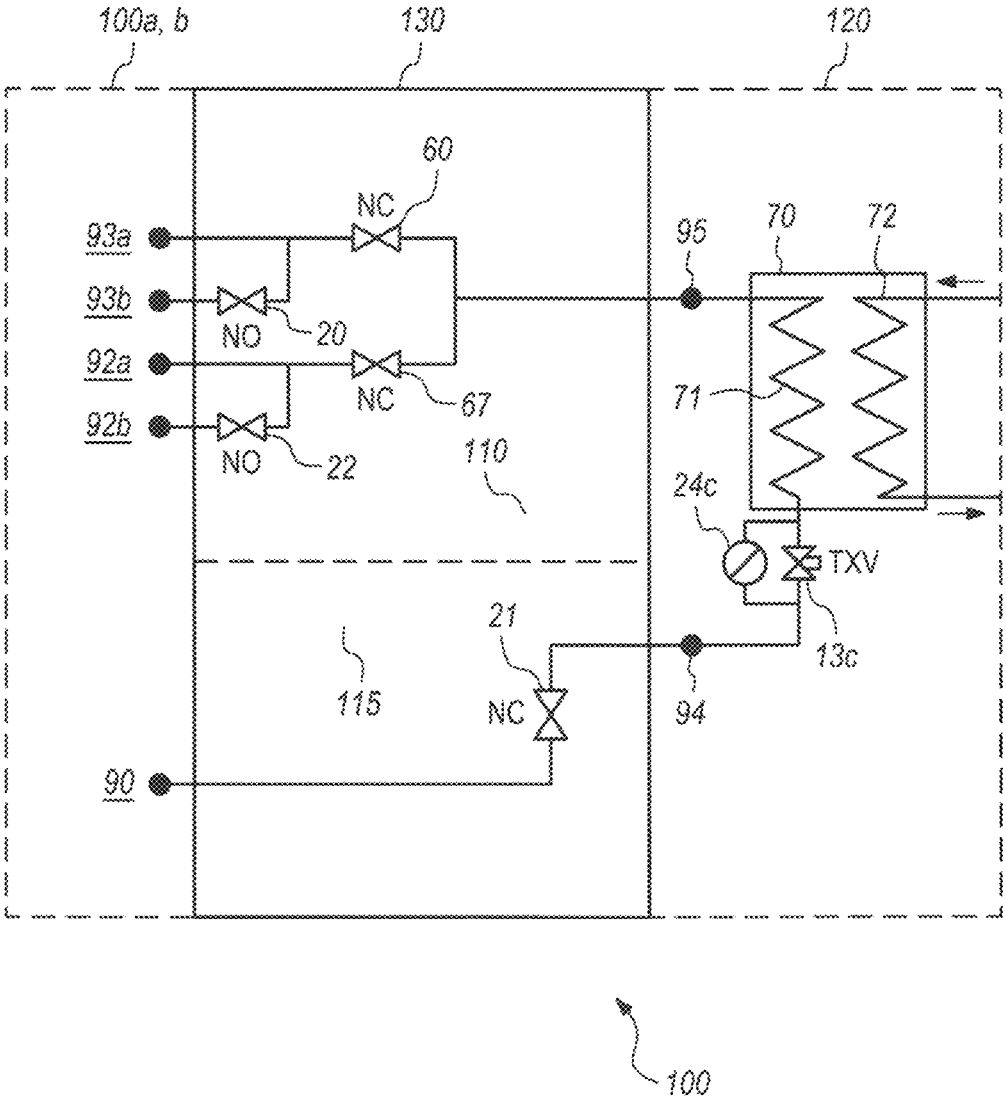
FIG. 11*a* is an example schematic of the configuration, and the relationship thereof, of the connecting points to the host receiving circuit, interconnecting circuit, and any interacting energy source system with fluid-to-liquid heat exchange coils.

FIG. 11*a* is a composite of relative components and a preferred embodiment of the present invention shown in a schematic with piping and valve connecting points. Piping and valves are shown within the boundary of solid line 130 where connecting points are shown outside solid line 130 as an example. Within the boundary set by solid line 130 are interconnecting gas circuit 110 and interconnecting liquid circuit 115. Within dash line 120 which may be included within piping and valving configuration 130 shows connecting points 94 and 95 that service EES 70, TXV 13*c*, and check valve 24*c*. Within dash line 100*a* and 100*b* show connecting points 92*a* and 92*b*, 93*a* and 93*b*, and 90. The preferred embodiment within 130 may be internal or external to 100*a* or 100*b* cabinetry. Solid line 130 may also be a separate auxiliary enclosure mounted externally with controlling analog, software, firmware, and voltage power aspects of the present invention included.

To further explain and illustrate EES 70, an internal representation is shown. Refrigerant gas or liquid flows in coil 71 bi-directionally whereas water or a water-based liquid will flow in coil 72 single directionally as shown with arrows. Instead of coil 72, which for clarity is shown separately, coils 71 and 72 may be a coil within a coil. Coil 71 may also be inserted and submerged in a tank of water or water-based liquid where coil 72 represents a tank rather than a coil.

Figure 11B:
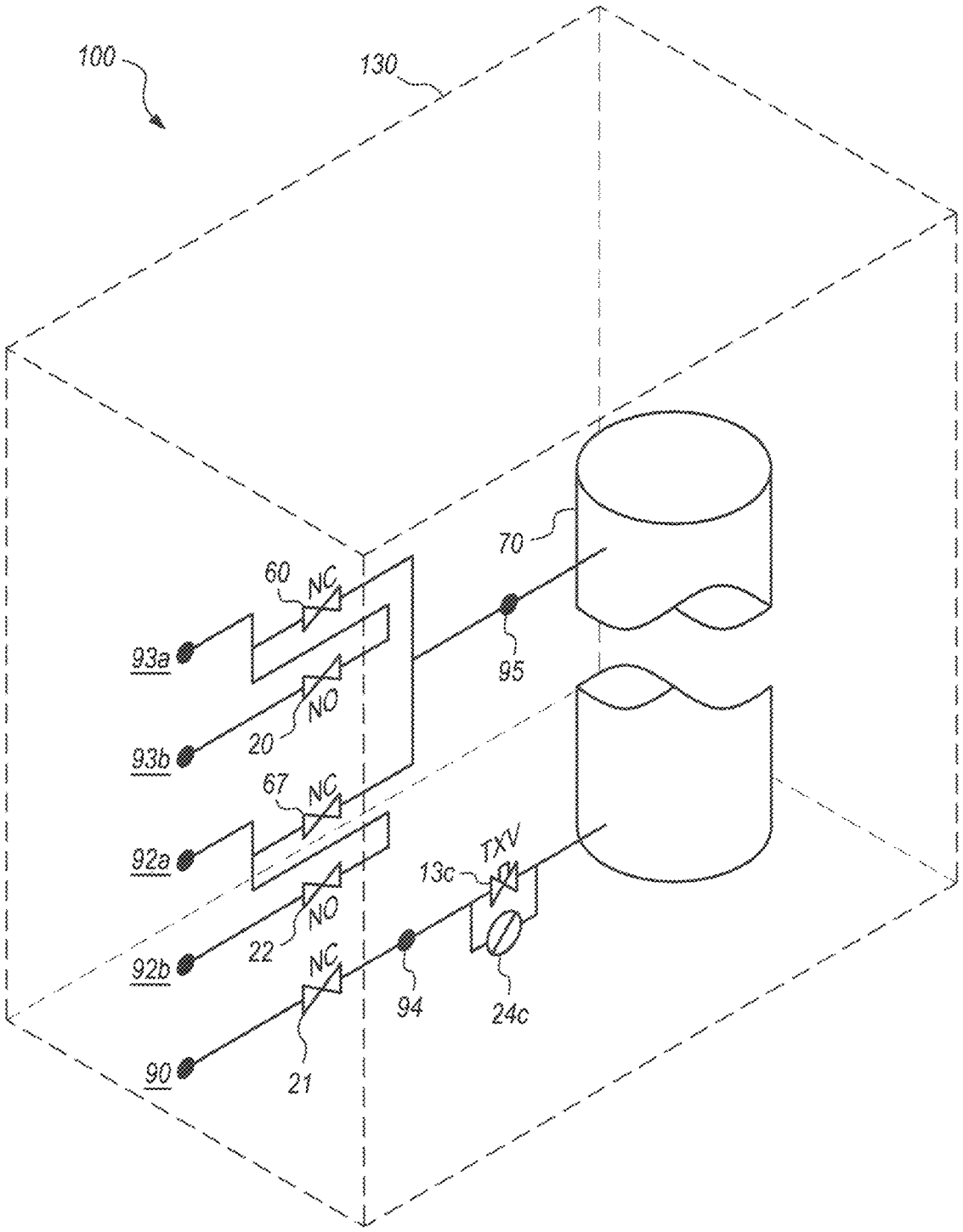
FIG. 11*b* is an isometric view of 11*a* where a three axis representation illustrates the subject configuration in an enclosure.

FIG. 11*b* is an isometric view showing an example of a piping configuration where circuits are tightly clustered.

Figure 12:
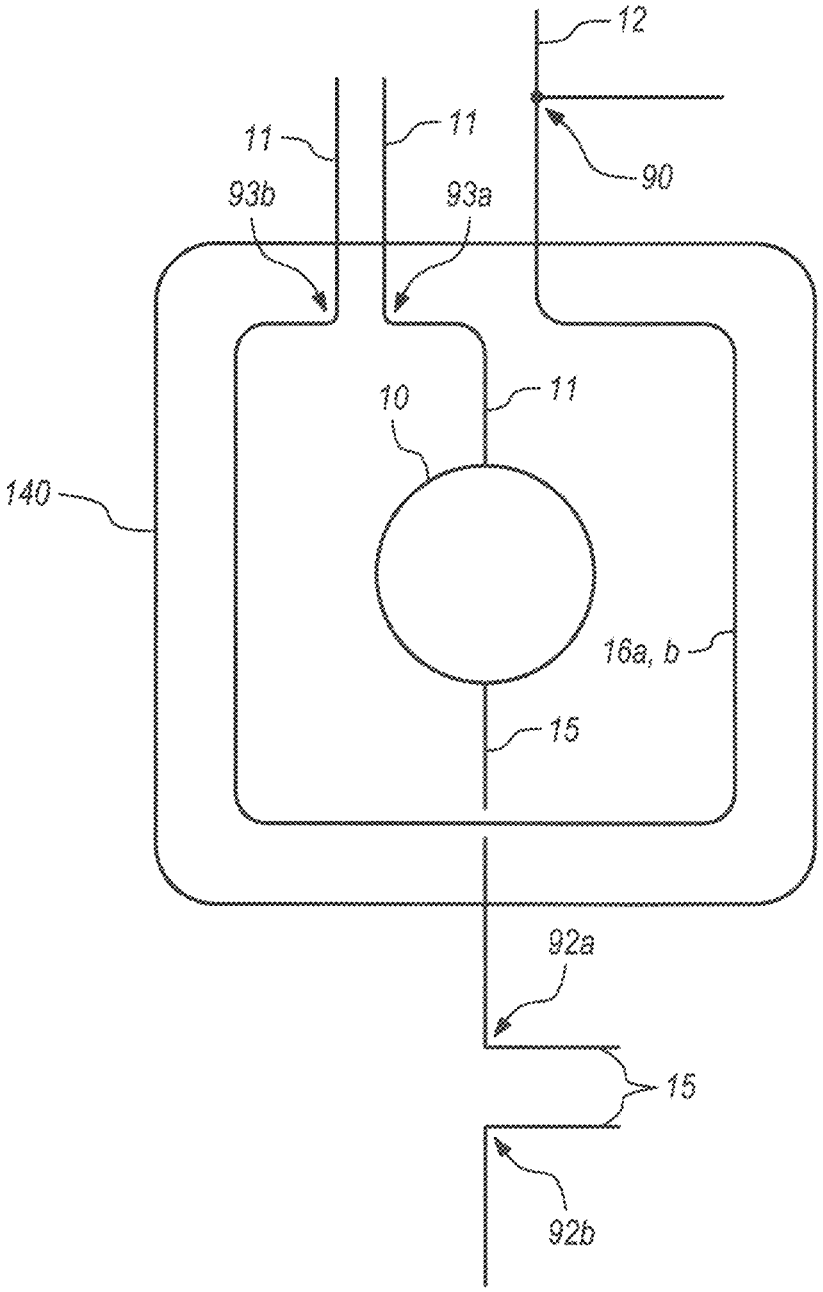
FIG. 12 is a schematic of the physical internal and external connecting points for a split condenser and the present invention.

FIG. 12 is a schematic of a conventional and most widely installed split system outdoor ambient heat exchange coil 16*a* or 16*b* and cabinet 140 showing connecting points external and internal to the coil cabinet 140. Reference is again made to FIGS. 10*a*, 10*b*, 11*a*, and 11*b*. Conventional installation of a split air conditioning or heat pump system and the placement of the coil cabinet 140 external to a structure requires the connection of refrigerant line 11 adjacent to outdoor heat exchange coil 16*a* or 16*b*. Accessibility to point 93 is internal to the outdoor coil cabinet 140 at a specified connecting point. In order to apply the present invention, an installer gains access to the discharge piping 11 at a specified point in cabinet 140 providing connection points 93*a* and 93*b*. It is anticipated that rigid or flexible piping is therefore installed and connected to an external apparatus housing 130 connections shown in FIGS. 11*a* and 11*b*. Access to connecting points 12 and 15 are external to cabinet 140 where accessibility is easily obtained where refrigerant lines are normally installed.

Figure 13A:
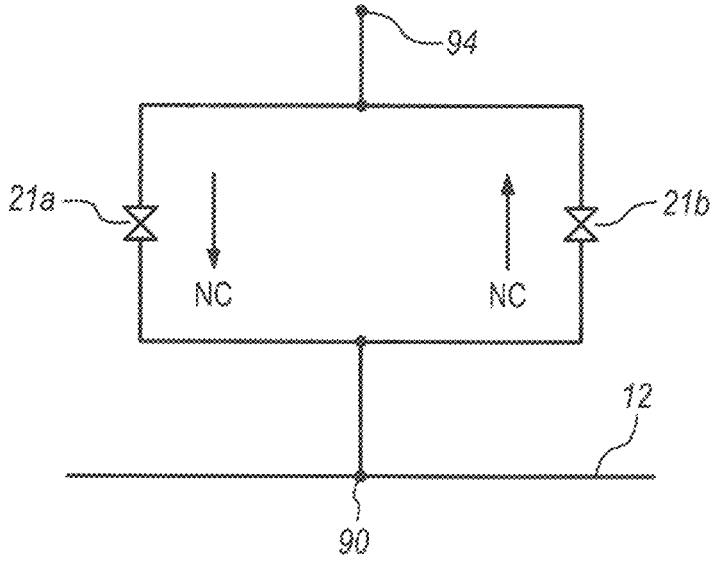
FIG. 13*a* is an example schematic of two-directional valving using one-directional actuatable valves in parallel.

FIG. 13*a* is a schematic to demonstrate alternative valving that may be employed within the scope of the present invention. In FIGS. 1-9 valve 21 is shown as a two-directional NC valve. Valves 21*a* and 21*b* could also be NC one-directional and are depicted installing them in parallel with their flow in reversing directions to accomplish an equivalency. Refrigeration valve manufacturers' rate valves for tonnage, flow, and pressure drops to meet standards, and, therefore valves 21*a* and 21*b* would be equal in size and rating for liquid flow.

Figure 13B:
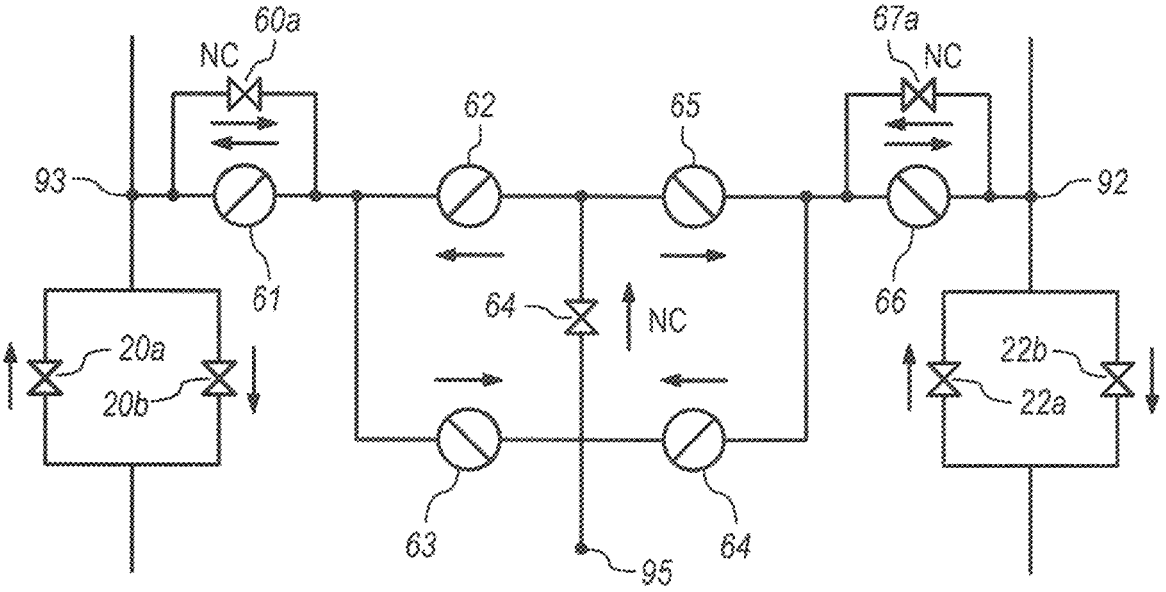
FIG. 13*b* is an example schematic of the host receiving and interconnecting piping and valves utilizing passive check valves and actuatable valves.

FIG. 13*b* is a schematic to demonstrate an alternative valving combining one-directional controlled solenoid valves and passive check valves. In FIGS. 1-9 valves 60 and 67 are shown as two-directional NC valves. In FIGS. 1-9 valves 20 and 22 are shown as two-directional NO valves. This schematic requires the addition of NC one-directional valve 64 to allow valve and piping schematic 13*b* to provide the equivalents of FIGS. 1-9. Therefore valves 20*a* and 20*b* would be equivalent to valve 20. Valves 22*a* and 22*b* would be equivalent to valve 22. Solenoid valve 60*a* and passive check valve 61 are equivalent to valve 60 and solenoid valve 67*a* and passive check valve 66 are equivalent to valve 67. Passive check valves 62, 63, 64, and 65 are required to provide the equivalent reversible gas flows in FIGS. 1-9. Those in the art will understand that passive check valves 61-66 may be replaced with the same valves represented by 60 and 67.

Figure 14:
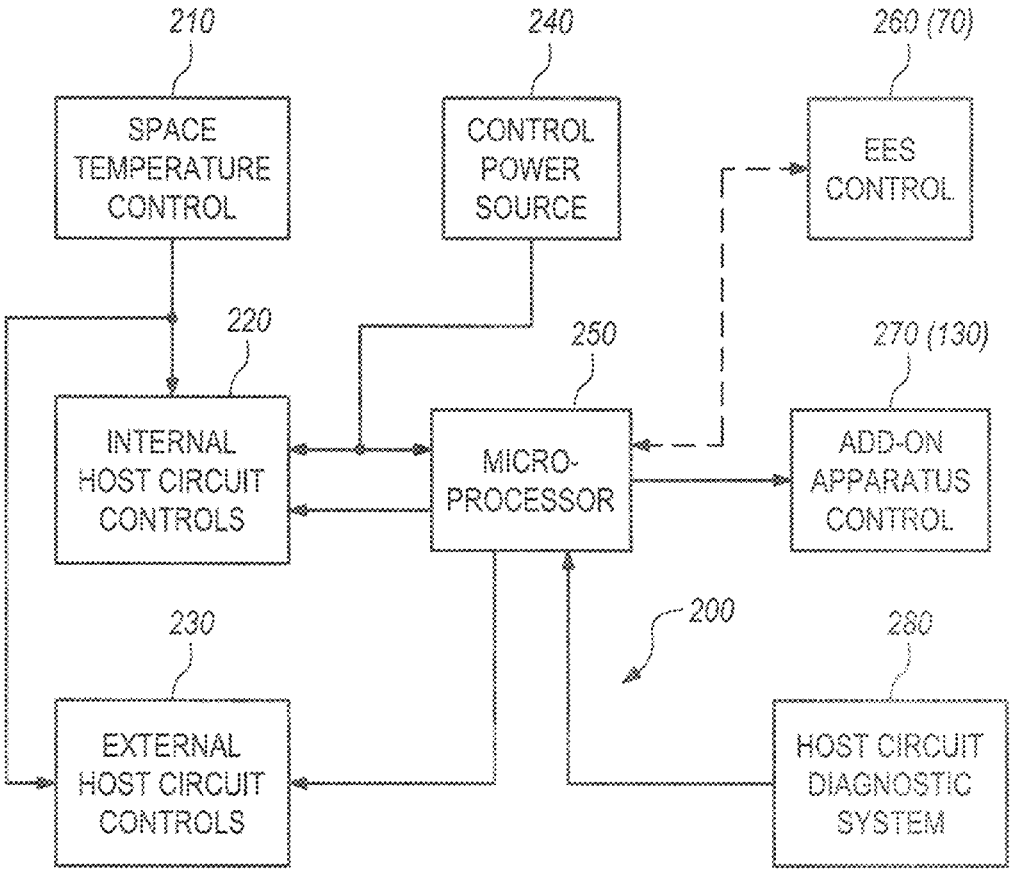
FIG. 14 is a schematic of control component flow paths for interconnecting electric and electronic communication.

FIG. 14 is a flow diagram of the electrical and electronic controls including analog, firmware, and software of the present invention and conventional air-source air conditioning 100*a* and heat pump 100*b* systems. In the following description of operation and the interconnecting communications relating to the operation of all referenced components within FIG. 14 are described in general. Conventional air-source air conditioners and heat pumps are manufacturer by multiple manufacturers and include multiple methods of control. In addition, compressor 10 may be single speed, two-speed, or variable speed. Start and stop of a compressor and associated mechanical fans are initiated by simple low-voltage to line-voltage start solenoid analog signals or complex electronic signals including Wi-Fi signals to start solenoids. The present invention, therefore, considers all aspects of compressor and mechanical fan controls as part of a general explanation as to how a conventional system relates to the present invention.

In FIG. 14, the controlling process and communication 200 is explained first by how a typical conventional air conditioning and heat pump system functions followed by the addition of EES control 260 (70) and add-on apparatus control 270 (130). An air-source system may be split into multiple components or in a single packaged unit. For purposes of explanation a split system is presented where controls physically exist at the indoor coil, outdoor coil, and the conditioned space. Space temperature control 210 conventionally controls the operation of these systems. A low-voltage signal supplied by control power source 240 is sent to an internal system control 220 indicating a call for cooling, or heating when a heat pump system is used. Indoor system control 220 starts the internal air supply fan moving air through a refrigerant heat exchange coil 18*a* or 18*b* suppling cool or warm air into the conditioned space. A low voltage signal is also sent to external system control 230 that starts the compressor 10, external fan 19*a*, and reversing valve 50 when a heat pump 100*b* is employed. The level of complexity of system process control 250 is determined, in part, by the application of the present invention and the EES control 260 (70) requirements. For example, a simple analog control may be desired to communicate with the controls of an air conditioner or heat pump and the add-on apparatus 270 (130). The system process control 250 may be reactive or proactive. If proactive, process control 250 will override space temperature control 210 and operate compressor 10 and either 19*a* or 19*b* as required for hot or cold storage demand. In addition, system process control may only receive a temperature signal from EES 70 or may have full control of EES 70. System process control 250 may include intelligent self-teaching software. User communication inputs and overrides are initiated through 250. For examples, a user can input the optimum time-of-use utility rates or exclude operation when electric vehicles are to be charged. Further, a diagnostic software program 280 may be employed that monitors the operating conditions of compressor 10 and host receiving circuit 100*a* and 100*b* pressure and temperature in order to maximize operating COP and system efficiency. Therefore, using diagnostic data from program 280 may operate the host system compressor outside of manufacturer's parameters that results in improved COP.

Figure 15:
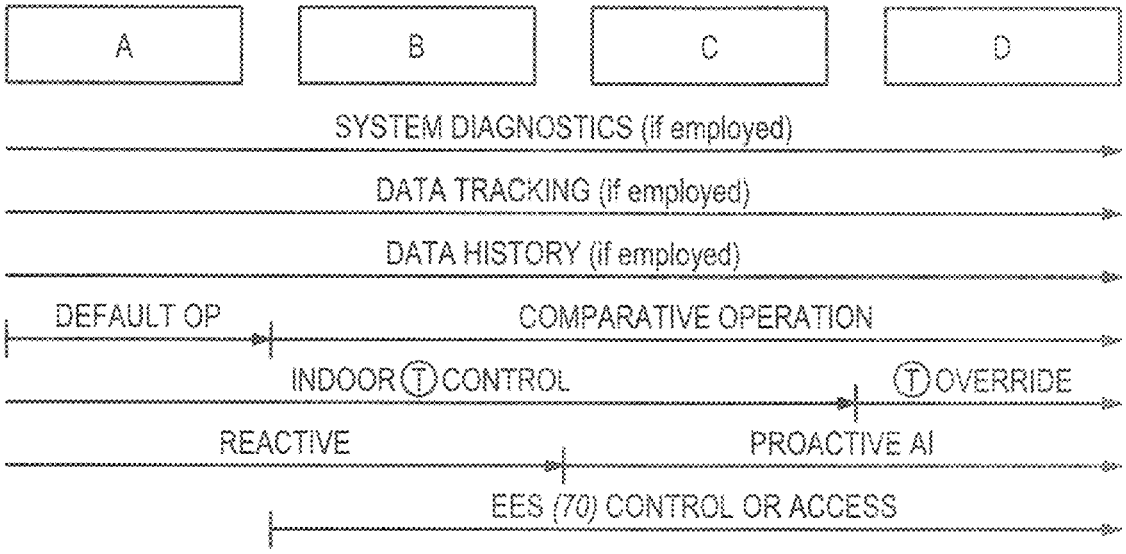
FIG. 15 is an operational schematic showing the sequence of electric and electronic interconnecting signal control communication.

FIG. 15 is a flow chart showing the software application of the present invention by the changing of hourly, daily, weekly, and monthly outdoor ambient conditions as well as the changing conditions of hot or cold energy sources. These changing conditions control the response complexities of A through D. The software is programmable for establishing parameters depending on the discretionary level of energy demand and/or energy storage required by the installer or end user. Within the operational control of condition A is a default operation of the host receiving system when external energy sources are inefficient for efficiency improvement. Power is provided to software for data tracking and storage (if employed), system diagnostics (if employed), data history (if employed), and calculations to determine any energy benefit of running auxiliary mechanical pumps, valves, or fans. The condenser coil fan (19*a*), the evaporator coil fan (19*b*), and the compressor (10) operate as normal in default mode controlled by an indoor thermostat. Within the operational control of condition B supplemental hot or cold energy is available periodically from energy sources. Under this condition a micro-processing circuit controls the host receiving and apparatus interconnecting circuits in an on-demand mode upon determination that other sources of energy are more efficient and available for absorption or dissipation heat transfer. The microprocessor provides host and interconnecting circuit control only when the indoor thermostat is calling for heating or cooling. The microprocessor may also sense the position of the reversing valve when applied to a heat pump. The microprocessor will receive signals from external sources such as sensors, pumps, or fans in external process fluid circuits to make control determinations. The microprocessor will control one or more mechanical fans within the host receiving circuit. Within the operational control of condition C a stored or continuous source of hot or cold energy relies on self-teaching software in order to maximize the use of the stored or continuous energy over a 24 hour period where the COP of the air conditioner or heat pump would otherwise be the lowest. The software is preprogrammed as to the sustainability of an energy source to allow the intelligent software to determine the optimum time or times to access the energy source. Continuous ground source versus limited tank storage source, for example. As with B the microprocessor will control one or more mechanical fans within the host receiving piping circuit. Within the operational control of condition D the microprocessor with self-teaching capabilities will override all host receiving piping circuit components and thermostat. This allows the operation of the compressor and outdoor mechanical fan when the indoor thermostat is not calling for heating or cooling. The microprocessor has had input by the installer or end user as to time-of-use rates and pre-determined optimum watt draws other than peak ambient periods. The self-teaching software, therefore, determines best times to operate host and interconnecting piping circuits to pre-heat or pre-cool energy storage sources in addition to normal storage methods.

It is to be understood that the embodiments of the present invention that are illustrated and described are merely exemplary and that a person skilled in the art can make many variations to those embodiments. It is to be also understood that the exemplary embodiments include the application of microprocessors using self-teaching prediction and anticipatory software and that there can be variations in the software language resulting in equivalents. All such embodiments are intended to be included within the scope of the present invention as defined by the following claims.

I claim:

1. An apparatus being a retrofit add-on method of alternating energy exchange for improving the efficiency of an air-source air conditioning or heat pump system in cooling or heat pump heating mode with the system having a host receiving piping circuit, an electric motorized compressor within the circuit utilizing two-phase refrigerant, electric motorized mechanical air fans, and multiple motor control electric circuits, the apparatus comprising:

single-directional or multi-directional selectable flow actuatable valves with reversing configurations embedded within a interconnecting refrigerant gas and liquid piping circuit between the host receiving piping circuit and an interacting energy exchange system, wherein the host receiving piping circuit has by installed retrofit a plurality of single-directional or multi-directional selectable flow actuatable valves and wherein the piping circuits allow heat exchange refrigerant gas to circulate from the discharge or to the suction of an air conditioner or heat pump compressor from and to the interacting energy exchange system;

an interconnecting controller coupled and in communication with the host receiving piping circuit valves and motors, the apparatus interconnecting piping circuit valves, and the interacting energy exchange system having sensors and actuators therein;

wherein the interconnecting controller controls multiple modes of operation, wherein the multiple modes of operation include;

a first mode where the interconnecting controller allows the air conditioner or heat pump to be in default mode from the apparatus and the interacting energy system wherein all selectable interconnecting valves are closed and the host circuit valves are open when access to the interacting energy exchange system is not satisfactory to improve efficiency;

a second mode where the interconnecting controller determines that access to the interacting energy exchange system is satisfactory to improve efficiency and opens or closes the host and apparatus selectable interconnecting valves, opens or closes one or more air fan motor circuits, and allows normally controlled operation; and a third mode where the system interconnecting controller overrides the operation of the air conditioner or heat pump normally controlled operation to open or close host and apparatus selectable interconnecting valves, initiates operation of the compressor motor and opens or closes one or more air flow inducing fan motor circuits for discharging or receiving energy through the interacting energy exchange system.

2. The retrofit apparatus according to claim 1 whereas the controller relies on multiple data references to control the selectable valves.

3. The retrofit apparatus according to claim 1, wherein self-teaching intelligent software is used for selecting optimum heat exchange.

4. The retrofit apparatus according to claim 1, wherein self-teaching intelligent software is used to override air conditioning or heat pump system controls and motors.

* * * * *